US006450854B1

(12) United States Patent
Fireman et al.

(10) Patent No.: US 6,450,854 B1
(45) Date of Patent: Sep. 17, 2002

(54) TOY HOOP

(75) Inventors: Andrew F. Fireman, North Bethesda; Thomas B. Eckert, Germantown, both of MD (US)

(73) Assignee: Riva Sports, Inc., Rockville, MD (US)

( * ) Notice: Subject to any disclaimer, the term of this patent is extended or adjusted under 35 U.S.C. 154(b) by 0 days.

(21) Appl. No.: 09/835,828

(22) Filed: Apr. 16, 2001

(51) Int. Cl.[7] ..... A63H 1/00

(52) U.S. Cl. ..... 446/236; 446/28; 446/26; 446/450

(58) Field of Search ..... 446/236, 251, 446/252, 254, 47, 220

(56) References Cited

U.S. PATENT DOCUMENTS

| | | | | | |
|---|---|---|---|---|---|
| 1,259,889 | A | | 3/1918 | MacDonald | |
| 1,489,550 | A | | 4/1924 | Shaffer | |
| 1,728,859 | A | | 9/1929 | Frame | |
| 2,738,616 | A | | 3/1956 | Windle | |
| 2,738,619 | A | | 3/1956 | Oquist | |
| 2,946,152 | A | | 7/1960 | Rubin | |
| 3,079,728 | A | | 3/1963 | Melin | |
| 3,326,551 | A | | 6/1967 | Clarke | |
| 3,729,860 | A | * | 5/1973 | Kargul | 446/236 |
| 3,881,277 | A | | 5/1975 | Delph et al. | |
| 3,918,708 | A | * | 11/1975 | Augusta | 446/265 |
| 3,956,851 | A | | 5/1976 | Tapinekis | |
| 4,090,324 | A | | 5/1978 | Compton | |
| 4,215,510 | A | | 8/1980 | Worrell | |
| 4,304,067 | A | | 12/1981 | Petrosky | |
| 4,480,831 | A | | 11/1984 | Muller-Deinhardt | |
| 5,022,646 | A | | 6/1991 | Kessler | |
| 5,338,244 | A | * | 8/1994 | Huang | 446/236 |
| 5,538,454 | A | | 7/1996 | Kessler | |
| 5,569,134 | A | * | 10/1996 | Nordanger | 446/236 |
| 5,823,846 | A | | 10/1998 | Arriola et al. | |
| 5,895,309 | A | * | 4/1999 | Spector | 446/236 |
| 5,997,449 | A | | 12/1999 | Lee | |
| 6,059,632 | A | * | 5/2000 | Sassak | 446/28 |

* cited by examiner

*Primary Examiner*—Derris H. Banks
*Assistant Examiner*—Ali Abdelwahed
(74) *Attorney, Agent, or Firm*—Steven N. Fox, ESQ

(57) ABSTRACT

The present invention is a toy hoop for use by a person. In one embodiment of the present invention, the toy hoop comprises a hoop member having first and second end portions and a first channel adapted to receive flow of a first medium such as water. The toy hoop further comprises an interconnect member having first and second end portions adapted to connect the first and second end portions of the hoop member. The interconnect member comprises a first channel in communication with the first channel of the hoop member to allow the first medium to flow there thru. Each of the first and second end portions have an outside surface and an inside surface. The inside surfaces are downwardly tapered to provide laminar flow of the first medium thru the first channel of the hoop member. The toy hoop further comprises a first inlet port in communication with the first channel to allow the person to adjust the volume of the first medium and therefore the mass of the hoop member and the centrifugal force. The toy hoop further comprises a first plug member adapted to engage with the first inlet port member to seal the first channel. In use, the person may fill the first channel of the hoop member with a desired volume of medium to obtain a desired mass and centrifugal force.

5 Claims, 3 Drawing Sheets

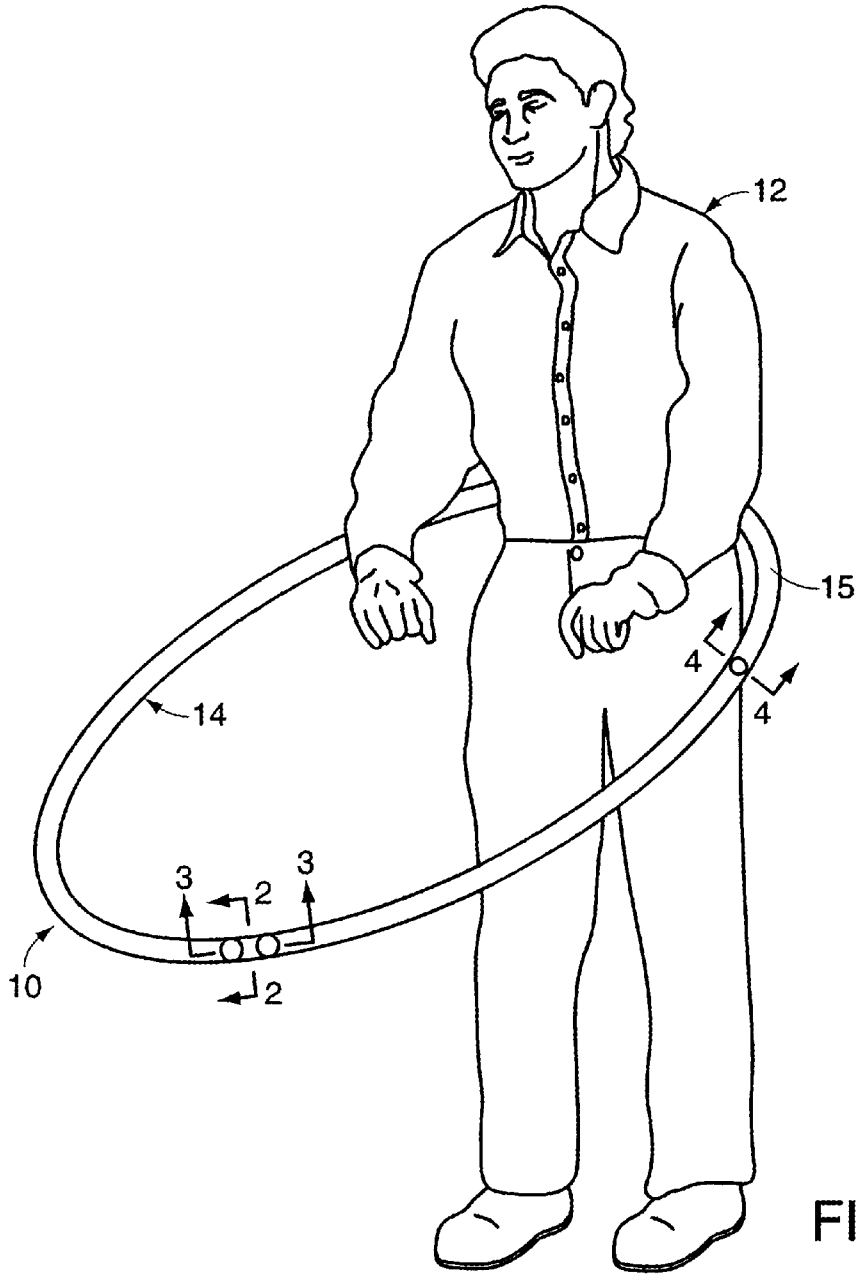
FIG. 1
FIG. 2
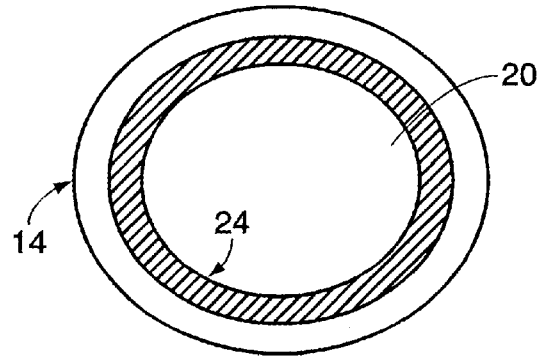

TOY HOOP

FIELD OF THE INVENTION

The present invention relates to the field of toy hoops.

BACKGROUND OF THE INVENTION

U.S. Pat. No. 2,946,152 entitled "Musical Hoop" and having a filing date of Sep. 15, 1998, and an issue date of Jul. 26, 1960, discloses a toy that many people generically call a "hula hoop." This patent discloses a toy hoop having a medium contained and flowing within the toy hoop to create sound as the hula hoop is used by a person. This patent discloses that "the means for creating sound comprises granules . . . such granules may include a wide variety of waters, such as buckshot, rice, wheat, and other grains, gravel, etc. . . ".

U.S. Pat. No. 5,022,646 entitled "Fluid Filled Jumping Stick" and having an issue date of Jul. 11, 1991, discloses an exercise toy in the form of a jump rope made of flexible tubing, a handle portion to which the ends of the flexible jump rope are connected thereto, and water contained and flowing within the flexible jump rope and handle portion to create a centrifugal force.

U.S. Pat. No. 5,022,646 entitled "Decoration of Children's Playthings Including An Exercise and Entertainment Hoop" and having an issue date of Jul. 23, 1996, discloses a toy hoop having a decorative pattern adhesively applied to the outside surface of the toy hoop.

SUMMARY OF THE PRESENT INVENTION

One object of the present invention was to develop a toy hoop that could be adjustably filled with a medium such as water, to allow the user to adjustably control the centrifugal force generated by the person's use of the toy hoop.

Another object of the present was to develop a toy hoop that could be adjustably filled with a medium such as water and/or bells, to allow the user to adjustably control the sound generated by the person's use of the toy hoop.

Another object of the present was to develop a toy hoop that could be adjustably filled with at least two separate mediums such as, water and/or bells, to allow the user to adjustably control the centrifugal force and sound generated by the person's use of the toy hoop.

The present invention is a toy hoop for use by a person. In one embodiment of the present invention, the toy hoop comprises a hoop member having first and second end portions and a first channel adapted to receive flow of a first medium such as water. The toy hoop further comprises an interconnect member having first and second end portions adapted to connect the first and second end portions of the hoop member. The interconnect member comprises a first channel in communication with the first channel of the hoop member to allow the first medium to flow there through. Each of the first and second end portions have an outside surface and an inside surface. The inside surfaces are downwardly tapered to provide laminar flow of the medium thru the first channel of the hoop member. The toy hoop further comprising a first inlet port in communication with the first channel to allow the person to adjust the volume of the first medium and therefore the mass and the centrifugal force when the toy hoop is used by the person. The toy hoop further comprises a first plug member adapted to engage with the first inlet port member to seal the first channel. In use, the person may fill the first channel of the hoop member with a desired volume of medium to obtain a desired mass, and centrifugal force and sound when used by the person.

In another embodiment of the present invention, the hoop member further comprises a second channel adapted to receive flow of a second medium, such as water. The interconnect member comprises a second channel of similar design to the first channel and in communication with the second channel of the hoop member to allow the second medium to flow there thru. The toy hoop further comprises a second inlet port in communication with the second channel to allow the person to adjust the volume of the second medium. The toy hoop further comprising a second plug member adapted to engage with the second inlet port member to seal the second channel. The hoop member and the first and second channels of the hoop member may be cylindrically shaped. The first channel is disposed closer to the outside surface of the hoop member than the second channel. In use, the person may fill the first and/or second channels of the hoop member with a desired volume of medium, such, as water, to obtain a desired mass and centrifugal force.

In another embodiment of the present invention, the hoop member may further comprise third and fourth channels adapted to receive flow of third and fourth mediums. The toy hoop may further comprise third and fourth inlet ports in communication with the third and fourth channels of the hoop member, respectively, to allow the person to adjust the volume of the third and fourth mediums. The interconnect member may comprise a third and fourth channel in communication with the third and fourth channels of the hoop member. The toy hoop may further comprise third and fourth inlet ports in communication with the third and fourth channels of the hoop member to allow the person to adjust the volume of third and fourth mediums, such, as water, to obtain a desired mass and centrifugal force when used by the person.

BRIEF DESCRIPTION OF THE DRAWINGS

The following detailed description of the invention will be better understood with reference to the drawings wherein:

FIG. 1 is a perspective view of a first embodiment of the toy hoop of the present invention showing an interconnect member and a single inlet port;

FIG. 2 is a cross-section view taken along line 2—2 of FIG. 1, showing the interconnect member and a single water channel;

DETAILED DESCRIPTION OF THE PREFERRED EMBODIMENTS

Figure 3:
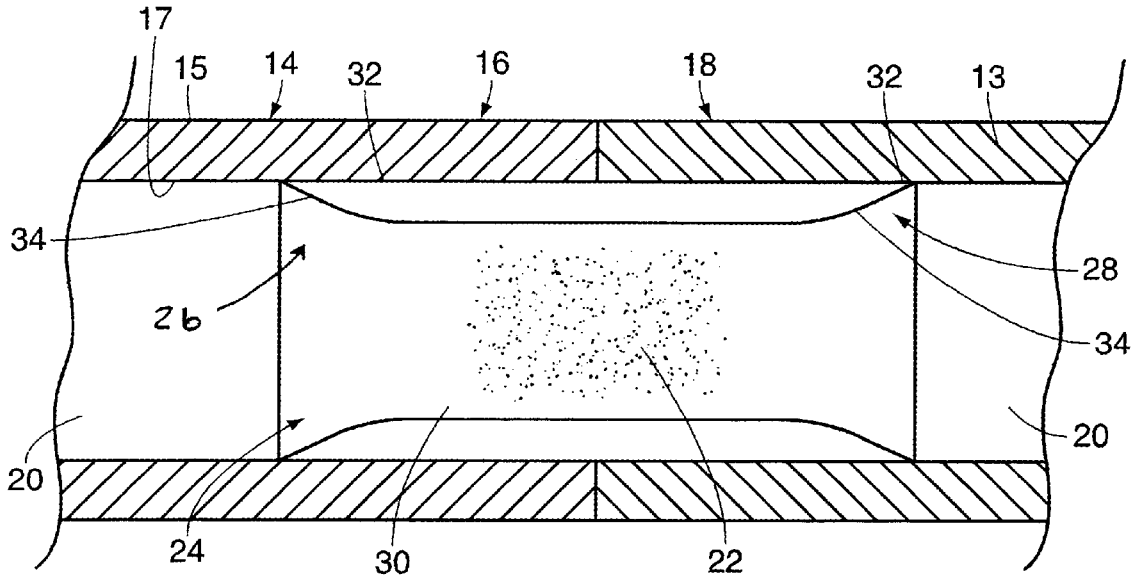
FIG. 3 is a cross-section view taken along line 3—3 of FIG. 1, showing the interconnect member.
Figure 4:
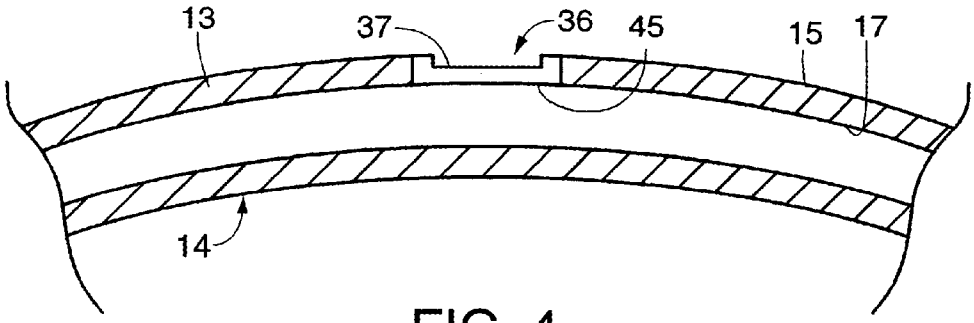
FIG. 4 is a cross-section view taken along line 4—4 of FIG. 1 showing a single inlet port of the present invention.
Figure 5:
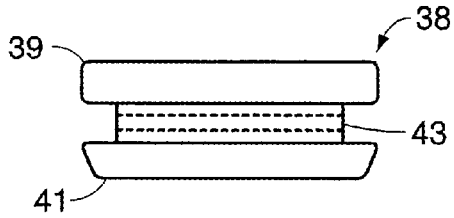
FIG. 5 is a perspective view of the plug member of the present invention.

Referring to FIGS. 1–5, where a first embodiment of a toy hoop 10 of the present invention is shown for use by a person 12. In this embodiment, the toy hoop 10 comprises a hoop member 14 having an annular wall 13, an outside surface 15, an inside surface 17, first and second end portions 16 and 18 and a first channel 20 adapted to receive flow of a first medium 22 such as water. In the embodiment shown, the hoop member 14 is elongated. The toy hoop 10 further comprises an interconnect member 24 having first and second end portions 26 and 28 adapted to connect the first and second end portions 16 and 18 of the hoop member 14. The interconnect member 24 comprises a first channel 30 in communication with the first channel 20 of the hoop member 14 to allow the first medium 22 to flow there thru. Each of the first and second end portions 26 and 28 of the interconnect member 24 have an outside surface 32 and an inside surface 34. The inside surfaces 34 are downwardly or inwardly tapered from a point inward of the first channel 30 to the first and second end portions 26 and 28 to provide laminar flow of the first medium 22 thru the first channel 20 of the hoop member 14. The outside surface 32 may be curved or otherwise shaped to the contour of the inside surface of the first and second end portions 16 and 18 of the hoop member 14 to further reduce friction and head loss. The toy hoop 10 further comprises a first inlet port 36 in communication the first channel 20 to allow the person 12 to adjust the volume of the first medium 22 and therefore the mass of the hoop member 14 and the generated centrifugal force. The first inlet port 36 has an opening 35 formed in the annular wall 13 and extending from the outside surface 15 to the inside surface 17. The first inlet portion 36 further comprises a recessed seat 37. The first inlet port 36 is disposed below the outside surface 15 of the hoop member 14 so that no portion of the first inlet port 36 protrudes outward from the outside surface 15. The toy hoop 10 further comprises a first plug member 38 adapted to engage with the first inlet port 36 to seal the first channel 20. The first plug member 38 generally comprises a one-piece unitary rubber body having a top portion 39 and a bottom or seal portion 41 that engages with the recessed seat 37 to seal the first channel 20. The first plug member 38 made by a wide variety of materials, designs and may be made by a wide variety of processes, including molding. To avoid injury and enhance operation, it is important that no portion of the first inlet port 36 and the first plug member 38 extend outward from the outside surface 15 of the hoop member 14. The first plug member 38 may comprise one or more threads 43 to engage with a thread portion 45 of the first inlet port 36. In use, the person 12 may fill the first channel 20 of the hoop member 14 with a desired volume of first medium 22 to obtain a desired mass, and centrifugal force and sound when used by the person. The first medium 22 may be any type of medium that increases the mass of the hoop member 14 and/or creates a sound when used by the person 12. By way of example only, such medium may include, alone or in combination, water, sand, bells, other objects and incompressible fluids and/or gases. By way of further example only, the first medium may be a combination of water and neon particles which upon use of the transparent hoop member 14 would result in the creation of a centrifugal force and emitted light when used by the person 12.

Figure 6:
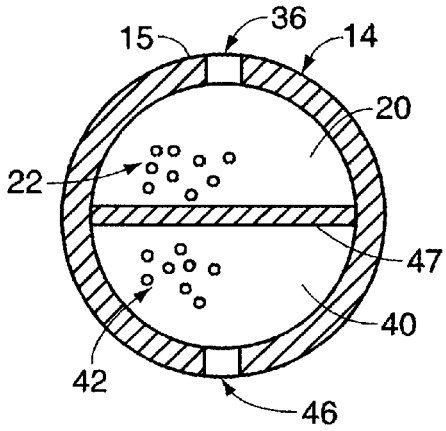
FIG. 6 is a cross section of a second embodiment of the present invention, showing the hoop member having two channels and two inlet ports.
Figure 8:
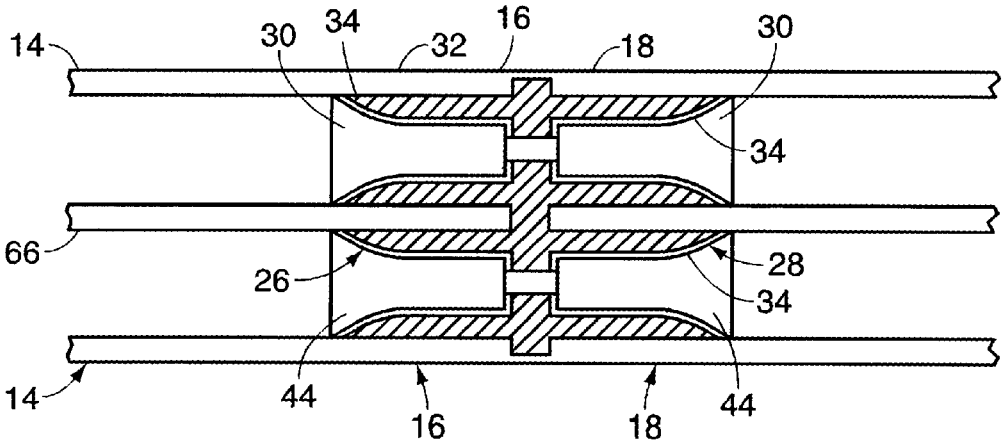
FIG. 8 is a cross section view showing an interconnect member have two channels.

Referring to FIGS. 6 and 8, wherein another embodiment of the present invention, the hoop member 14 further comprises a second channel 40 formed by a wall 47 and adapted to receive flow of a second medium 42, such as water. The interconnect member 24 comprises a second channel 44 of similar design to the first channel 30 and in communication with the second channel 40 of the hoop member 14 to allow the second medium 42 to flow there thru. The toy hoop 10 further comprises a second inlet port 46 in communication the second channel 40 to allow the person 12 to adjust the volume of the second medium 42. The toy hoop 10 further comprises a second plug member 48 adapted to engage with the second inlet port member 46 to seal the second channel 40. The hoop member 14 and the first and second channels 20 and 40 of the hoop member 14 may be cylindrical shaped. The first channel 20 may be spaced closer to the outside surface 15 of the hoop member 14 then the second channel 40. In use, the person 12 may fill the first and/or second channels 20 and 40 of the hoop member 14 with a desired volume of first and second medium 22 and 42, respectively, to obtain a desired mass and centrifugal force when used by the person 12. The first and second mediums 22 and 42 may be any type of medium that increases the mass of the hoop member 14 and/or which creates one or more sounds when used by the person 12. By way of example only, the first and second mediums 22 and 42 may include, alone or in combination, water, sand, bells, other objects and incompressible fluids and/or gases. By way of example only, the first medium 22 could be water and the second medium 42 could be bells. By way of further example only, the first medium 22 could be bells having a certain tone or sound and the second medium could be bells having a different tone or sound.

Figure 7:
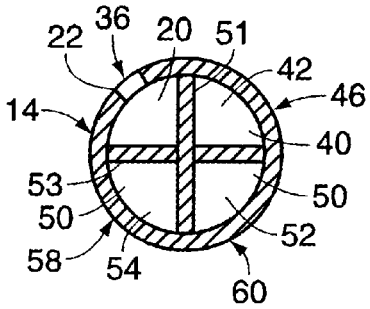
FIG. 7 is a cross-section view showing the hoop member having four channels and two inlet ports.

Referring to FIG. 7, wherein another embodiment of the present invention, the hoop member 14 may comprise third and fourth channels 50 and 52 formed by walls 51 and 53 and adapted to receive flow of third and fourth mediums 54 and 56. The toy hoop 10 may further comprise third and fourth inlet ports 58 and 60 in communication with the third and fourth channels 50 and 52 of the hoop member 14 to allow the person to adjust the volume of the third and fourth mediums 54 and 56. The interconnect member 24 may comprise third and fourth channels 62 and 64 in communication the third and fourth channels 50 and 52 of the hoop member 14. The first and second mediums 22 and 42 and the third and fourth mediums 54 and 56 may be any type of medium that increases the mass of the hoop member 14 and/or which creates one or more sounds when used by the person 12. By way of example only, the first and second mediums 22 and 42 may include, alone or in combination, water, sand, bells, other objects and incompressible fluids and/or gases. By way of example only, the first medium 22 could be water, the second medium 42 could be bells having a certain tone or sound, the third medium could be bells having a different tone or sound than the second medium, and the fourth medium could be bells having a different tone or sound then the second or third mediums. The hoop member 14 may include one or more drain ports (not shown) to drain the mediums.

The hoop member 14 and the interconnect member 24 are each preferably made from extruded polyethylene (PE) and cut to form a pre-defined shape and size. The pre-defined shape of the hoop member 14 is inserted into a lower mold cavity along with the interconnect member 24 connected to the first and second end portions of the hoop member 14. Upon closing of an upper mold with the lower mold, the interconnect member 24 is heat bonded with the first and second end portions of the hoop member 14.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A toy hoop for use by a person comprising:

(a) a hoop member having an outside surface, first and second end portions and a first channel adapted to receive a first medium; and (b) an interconnect member having a first channel and first and second end portions; each of said first and second end portions having an outside surface and an inside surface, said inside surface of said first and second end portions being inwardly tapered from a point within said first channel of said interconnect member to said first and second end portions, respectively.

2. The toy hoop of claim 1, wherein said hoop member further comprises a first inlet portion in communication with said first channel of said hoop member to allow the person to adjust a volume of said first medium, said first inlet portion being disposed below said outside surface of said hoop member.

3. The toy hoop of claim 2, wherein said hoop member further comprises a plug member adapted to engage with said first inlet portion of said hoop member and to seal said first channel of said hoop member and said first channel of said interconnect member, said plug member being disposed below said outside surface of said hoop member.

4. The toy hoop of claim 3, wherein said first inlet portion comprises an opening formed in an annular wall of said hoop member.

5. The toy hoop of claim 4, wherein said opening of said first inlet portion extends from said outside surface of said hoop member to an inside surface of said hoop member.

* * * * *